United States Patent [19]

Nagode

[11] 4,292,759

[45] Oct. 6, 1981

[54] PUSH-PULL WHEEL ACTION TOY

[75] Inventor: Larry R. Nagode, East Aurora, N.Y.

[73] Assignee: The Quaker Oats Company, Chicago, Ill.

[21] Appl. No.: 114,417

[22] Filed: Jan. 22, 1980

[51] Int. Cl.[3] ..... A63H 11/10

[52] U.S. Cl. ..... 46/205

[58] Field of Search ..... 46/205, 204, 114, 220, 46/106, 107, 103, 104, 97

[56] References Cited

U.S. PATENT DOCUMENTS

| | | | |
|---|---|---|---|
| 246,586 | 9/1881 | Adams et al. | 46/107 |
| 1,168,269 | 1/1916 | Allen | 46/205 |
| 1,223,287 | 4/1917 | Morse | 46/104 X |
| 1,643,916 | 9/1927 | Becker | 46/220 X |
| 2,404,186 | 7/1946 | Mariani | 46/204 X |
| 2,724,925 | 11/1955 | Fisher et al. | 46/204 X |
| 3,240,201 | 3/1966 | Shelton | 46/205 X |

FOREIGN PATENT DOCUMENTS

| | | | |
|---|---|---|---|
| 274554 | 4/1951 | Switzerland | 46/106 |

*Primary Examiner*—Gene Mancene
*Assistant Examiner*—Mickey Yu
*Attorney, Agent, or Firm*—Cumpston & Shaw

[57] ABSTRACT

A push-pull wheel action toy is disclosed having a figure head mounted on a vertically extending push rod. The push rod is coupled to a wheel on the toy such that rotation of the wheel upon pushing or pulling the toy imparts up and down and rotational movements to the push rod and figure head.

4 Claims, 4 Drawing Figures

PUSH-PULL WHEEL ACTION TOY

BACKGROUND OF THE INVENTION

1. Field of the Invention

This invention relates generally to toys, and more particularly to an improved push-pull wheel action toy. The invention involves a novel way of coupling a wheel of the toy to a vertically extending push rod for imparting up and down and rotational movements to the push rod.

2. Description of the Prior Art

U.S. Pat. No. 2,724,925 discloses a toy vehicle having an up and down movable push rod onto which a figure head is mounted. A cam member on a wheel axle is offset from the axis of the push rod and engages a pedestal on the push rod for simultaneously imparting up and down and rotational movements to the push rod and figure head. A problem with this toy vehicle is that the force for imparting rotational movement to the push rod is not a positive force. Instead, the rotation imparting force depends entirely upon the friction between the pedestal and cam member which varies with use and is not too dependable.

U.S. Pat. No. 3,708,912 discloses a bouncing passenger vehicle toy in which a plate is driven vertically by multi-lobed cams on the vehicle axles as the vehicle rolls along. No provision is made in this vehicle for imparting rotational movement to the passengers.

U.S. Pat. No. 3,827,179 discloses a wheeled toy vehicle having a cam operated oscillating chair and steering wheel. One of the wheels has a cam surface that moves reciprocally as the wheel rotates, and a cam follower engages the cam surface so as to oscillate an upright stem around its axis in response to wheel rotation. The operator's chair is mounted on the upright stem to oscillate therewith, and the steering wheel is preferably engaged by a projection from the chair for oscillating the steering wheel with the chair. A problem with this toy vehicle is that the operator's chair is not raised and lowered. Furthermore, it would be difficult, if not impossible, to modify the mechanism to raise and lower the chair in addition to imparting oscillation thereto.

Although the aforementioned prior art toys operate satisfactorily, none of them have the advantage inherent in the action toy of this invention of positive means for initially raising and lowering a push rod onto which a figure head is mounted, and then positively rotating the push rod and figure head through a predetermined angle when the push rod is substantially in its lowermost position. Another advantage of the action toy of this invention is that the toy and the positive means incorporated therein are of an extremely rugged and durable construction capable of withstanding the heavy abuse to which they are subjected by children without suffering significant damage.

SUMMARY OF THE INVENTION

A primary object of the present invention is to provide a novel push-pull wheel action toy having a figure head mounted on a vertically extending push-rod. Positive means are provided for coupling the push rod to a wheel of the toy such that rotation of the wheel, upon pushing or pulling the toy, imparts up and down and rotational movements to the push rod and figure head.

In one aspect of the invention, the push rod is provided at its lower end with a plurality of angularly spaced, radially extending fins. The wheel has a cam member integral therewith and aligned with the axis of the push rod for engaging and imparting up and down movement to the push rod. The wheel further has a lug integral therewith and off set from the axis of the push rod and in alignment with at least one fin for engaging and imparting rotational movement to the push rod.

In another aspect of the invention, the cam member and lug are angularly spaced whereby the up and down and rotational movements of the push rod and figure head occur in succession.

In still another aspect of the invention, the action toy has a single egg-shaped wheel.

In a more specific aspect of the invention, the egg-shaped wheel has a center peripheral groove defining a continuous base radially spaced from the wheel axis. The base has a substantially square cross section forming a plurality of angularly spaced cam members for engaging and imparting up and down movement to the push rod. The groove further has a side surface transverse to the wheel axis. The side surface and base cooperate to define angularly spaced, radially extending projections or lugs which are angularly interposed substantially between the cam members for engaging and imparting rotational movement to the fins and push rod.

The summarized aspects of the push-pull wheel action toy of the present invention solve the aforementioned and other problems presented by prior art action toys. For example, the present invention provides positive means for imparting up and down and rotational movements to the push rod and figure head mounted thereon. An advantage of this is that the most desirable feature of this type of action toy is achieved, namely constant, reliable, attractive and interesting up and down and rotational movements of the rod and figure head when the toy is pushed or pulled. Another advantage of this invention is that the positive means for imparting up and down and rotational movements are constructed and arranged in a way that greatly enhances the durability and ruggedness of the action toy.

The invention and its advantages will become more apparent from the detailed description of the invention presented below.

BRIEF DESCRIPTION OF THE DRAWING

The details of the invention will be described in connection with the accompanying drawing, in which.

DETAILED DESCRIPTION OF THE INVENTION

Figure 1:
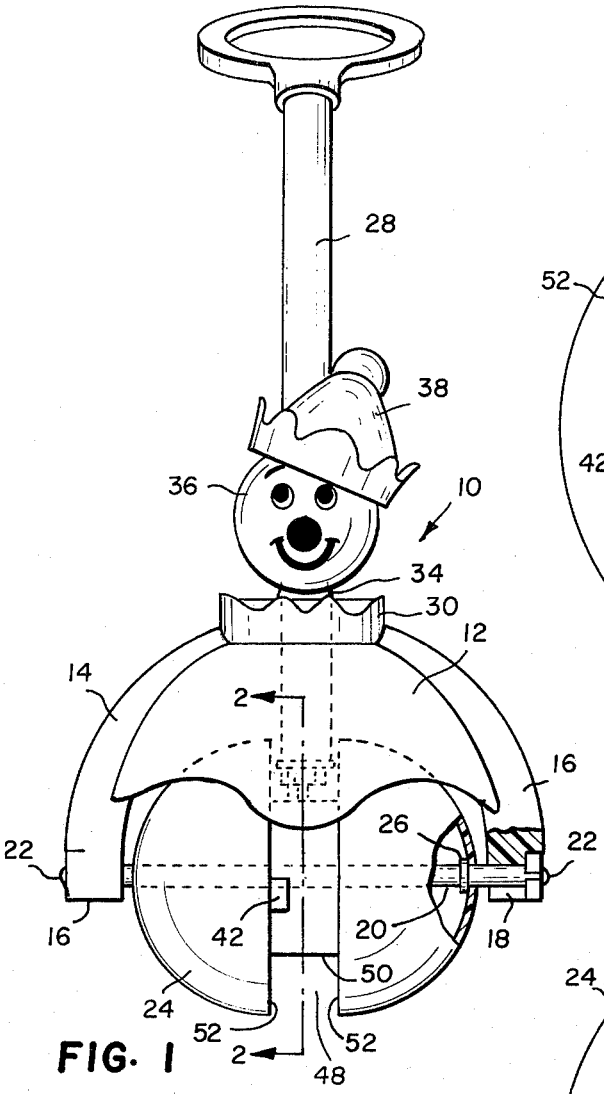
FIG. 1 is a front elevational view of a preferred embodiment of the push-pull wheel action toy of this invention.

Referring to FIG. 1 of the drawing, a preferred embodiment of a push-pull wheel action toy 10 of this invention is disclosed comprising an inverted cup-shaped body 12 in the form of a clown's skirt. The skirt has diametrically opposed arms 14 in which end portions 16 thereof extend below body 12. End portions 16, one of which is shown sectioned, have aligned blind notches 18 into which ends of an axle 20 are nested and fixedly held in place by pins 22.

An egg-shaped wheel 24 simulating a clown's baggy trousers is rotatably mounted on axle 20 and axially positioned thereon by ring 26 or the like. An upper portion of wheel 24 is recessed into the cupshaped body 12. A handle 28 is secured to body 12 by which the body can be pushed or pulled causing wheel 24 to rotate.

The body 12 further has a collar or neck portion 30 having a central vertical cylindrical opening 32 (FIG. 2) within which a cylindrical push rod 34 is mounted for up and down movement. A figure head 36 shown as a clown's head with an appropriate hat 38 is secured to the upper end of push rod 34. All of the portions of the clown's figure such as body or skirt 12, neck 30, head 36, hat 38 and baggy trousers or wheel 24 and any insignia thereon are painted or imprinted in suitable colors to provide an attractive stimulating action toy for children.

The push-pull wheel action toy 10 of this invention is further provided with means coupling wheel 24 to push rod 34 for imparting up and down and rotational movements thereto upon rotation of the wheel in either direction. The coupling means comprises a cam member 40 and lug 42 on wheel 24 coacting with a cam follower 44 and fins 46 respectively on push rod 34.

Figure 2:
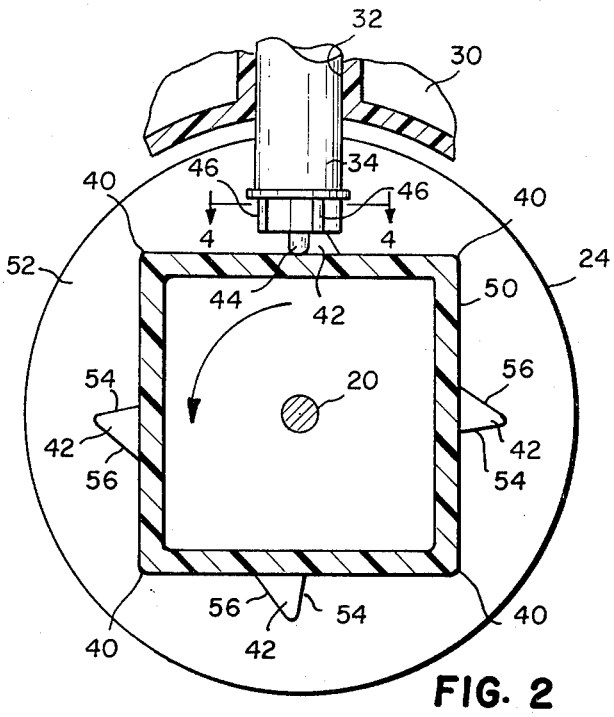
FIG. 2 is an enlarged section view taken substantially along line 2—2 of FIG. 1 showing the push rod about to be rotated.
Figure 3:
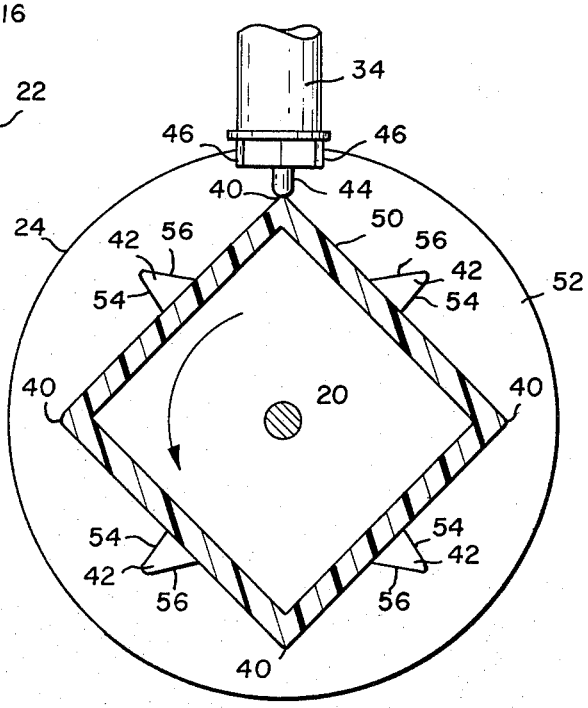
FIG. 3 is a view similar to FIG. 2 showing the push rod raised to its highest position.

More specifically, with reference to FIGS. 1–3, wheel 24 has a central peripheral groove 48 having a continuous base surface 50 of substantially square cross section. The cam follower 44 on push rod 34 comprises an axially extending finger on the end of the push rod which is urged by gravity against continuous base surface 50. The corners of base surface 50 form one or more of the aforementioned cam members 40 which, upon rotation of wheel successively raise and lower push rod 34 and figure head 36; that is, impart up and down movement thereto.

Figure 4:
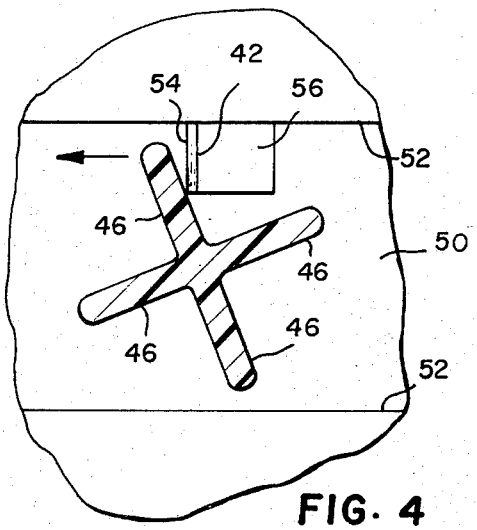
FIG. 4 is an enlarged segmental section view taken substantially along line 4—4 of FIG. 2.

With reference to FIGS. 1, 2 and 4, push rod rod 34 is provided at the fixed end of finger 44 with a plurality of radially extending, angularly spaced aforementioned fins 46 offset from the axis of the push rod as best seen in FIG. 4. Groove 48 has side surfaces 52, one of which in conjunction with base surface 50 defines integrally formed radially extending aforementioned lugs 42 angularly spaced substantially between the high points of the cam members 40. Lugs 42 all lie in a plane parallel to the axis of push rod 34 and spaced therefrom a distance less than the width of a fin 46. Accordingly, upon rotation of wheel 24, fin striking surfaces 54, 56 of each lug, depending upon the direction of rotation of the wheel, will strike a fin 46 lying in its path for imparting rotational movement to the fin and push rod 34 through a predetermined angle of substantially 90 degrees. By angularly spacing fins 46 about 90 degrees apart, each partial rotation of push rod 34 reintroduces a new fin in the path of succeeding lug 42. Lugs having fin striking surfaces 54, 56 that extend substantially radially from the wheel axis are believed to provide the best rotational movement of push rod 34. Since a base surface and a side surface of each lug 42 are integrally molded with base and side surfaces 50, 52 respectively of groove 48, it is possible to mold the lugs with relatively steep fin striking surfaces 54, 56 without sacrificing lug durability and strength. However, one of the surfaces 54 will normally be steeper than the other surface 56.

In the operation of this invention, a child will pull and push the action toy 10 by its handle 28. Rotation of wheel 24 in either direction will impart successive cycles of motion to the toy. Each cycle of motion involves raising and lowering push rod 34 by a cam member 40, and then striking a fin 46 by a fin striking surface 54, 56 of a lug 42 for rotating the push rod through an angle of about 90°. These combined movements imparted to push rod 34 and figure head 36 result in an action toy that is very attractive and highly interesting to children.

While a presently preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A push-pull wheel action toy comprising:
a body;
a wheel rotatably supported by said body;
a vertical opening in said body generally extending above said wheel;
a push rod mounted within said opening for alternate up and down rotational movements;
a figure head secured to the upper end of said push rod;
a plurality of angularly spaced radially extending fins secured to the lower end of said push rod;
at least one cam member on said wheel arranged in alignment with said push rod for engaging said lower end of said push rod and imparting up and down movement to said push rod and figure head upon rotation of said wheel; and
at least one lug on said wheel separate from said cam member and arranged laterally offset from said push rod and in alignment with at least one of said fins for intermittently engaging and rotating said fin, said push rod and said figure head through a preselected angle upon rotation of said wheel, said cam member and said lug further being angularly displaced on said wheel for alternately imparting up and down and rotational movement to said push rod and said figure head.

2. A push-pull wheel action toy according to claim 1 wherein said wheel is egg-shaped.

3. A push-pull wheel action toy comprising:
a body;
a wheel rotatably supported by said body, said wheel having a peripheral groove defining a continuous base radially spaced from the wheel axis, and a side surface transverse to the wheel axis;
a vertical opening in said body generally extending above said wheel;
a push rod mounted within said opening for up and down and rotational movements;
a figure head secured to the upper end of said push rod;
a plurality of angularly spaced radially extending fins secured to the lower end of said push rod;
at least one cam member defined by said base on said wheel, said cam member being arranged in alignment with said push rod for engaging said lower end of said push rod and imparting up and down movement to said push rod and figure head upon rotation of said wheel; and
at least one radially extending lug on said wheel defined by said side surface in conjunction with said base and separate from said cam member and arranged laterally offset from said push rod and in alignment with at least one of said fins for intermittently engaging and rotating said fin, said push rod and said figure head through a preselected angle upon rotation of said wheel.

4. A push-pull wheel action toy according to claim 3 wherein said body is cup-shaped, said wheel is egg-shaped and a portion of said wheel extends into said cup-shaped body, said base having a substantially square cross section to form a plurality of angularly spaced cam members, a plurality of angularly spaced, radially extending lugs defined by said side surface and base, each lug angularly interposed substantially between a successive pair of cam members.

* * * * *